US010352052B2

(12) United States Patent
Faresin

(10) Patent No.: US 10,352,052 B2
(45) Date of Patent: Jul. 16, 2019

(54) FORMWORK FOR PERFORMING HORIZONTAL CASTINGS FOR THE PROVISION OF FLOORS

(71) Applicant: FARESIN BUILDING S.P.A., Breganze (IT)

(72) Inventor: Guido Faresin, Bassano del Grappa (IT)

(73) Assignee: FARESIN BUILDING S.P.A., Breganze (IT)

( * ) Notice: Subject to any disclaimer, the term of this patent is extended or adjusted under 35 U.S.C. 154(b) by 323 days.

(21) Appl. No.: 15/467,292

(22) Filed: Mar. 23, 2017

(65) Prior Publication Data

US 2017/0275902 A1 Sep. 28, 2017

(30) Foreign Application Priority Data

Mar. 24, 2016 (IT) ..... 102016000030716

(51) Int. Cl.
*E04G 11/48* (2006.01)
*E04G 11/50* (2006.01)
(Continued)

(52) U.S. Cl.
CPC ..... *E04G 11/483* (2013.01); *E04G 11/38* (2013.01); *E04G 11/52* (2013.01); *B28B 1/14* (2013.01)

(58) Field of Classification Search
CPC ..... E04G 11/36; E04G 11/38; E04G 11/483; E04G 11/50; E04G 11/52
(Continued)

(56) References Cited

U.S. PATENT DOCUMENTS 1,907,877 A * 5/1933 Roos ..... E04G 11/486 249/193
3,614,048 A * 10/1971 Young ..... B28B 7/0032 249/18
(Continued)

FOREIGN PATENT DOCUMENTS

DE 2648281 * 4/1978 ..... E04G 11/483
DE 3147081 A1 * 12/1982 ..... E04G 7/307
(Continued)

OTHER PUBLICATIONS

Italian Search Report and Written Opinion dated Mar. 31, 2016 issued in IT UB20152326.

*Primary Examiner* — Michael Safavi
(74) *Attorney, Agent, or Firm* — Scully, Scott, Murphy & Presser, P.C.

(57) ABSTRACT

A formwork for performing horizontal castings for the provision of floors, of the type comprising a series of props, and supporting heads to be arranged on the props for the resting of panels designed to form a surface for a concrete casting, each panel comprising at least two longitudinal profiles, for resting on the supporting heads;

each one of the longitudinal profiles comprises a central body, a first longitudinal part, for the fixing of the transverse elements, and an opposite second longitudinal part, each one of the supporting heads comprises a plate-like base from which there extends at least one lateral shoulder for the resting of the central body of a longitudinal profile in an intermediate configuration for assembly or disassembly, and a central protrusion, which protrudes from the same side as the lateral shoulders.

14 Claims, 8 Drawing Sheets

(51) Int. Cl.
*E04G 11/38* (2006.01)
*E04G 11/52* (2006.01)
*B28B 1/14* (2006.01)

(58) Field of Classification Search
USPC ..... 248/357, 354.5, 354.6
See application file for complete search history.

(56) References Cited

U.S. PATENT DOCUMENTS 5,614,122 A * 3/1997 Schworer ..... E04G 11/483 249/18
5,651,914 A * 7/1997 Schworer ..... E04G 11/48 249/210
6,109,191 A * 8/2000 Schworer ..... E04G 11/483 108/115
7,581,709 B2 * 9/2009 Gillespie ..... E04G 11/38 249/19
7,640,871 B2 * 1/2010 Arozena Bergaretxe ..... E04G 11/38 108/150
8,262,056 B2 * 9/2012 Schwoerer ..... E04G 11/483 248/357
9,540,830 B2 * 1/2017 Rosati ..... E04G 17/001
10,053,875 B1 * 8/2018 Baron ..... E04G 11/50
10,119,282 B2 * 11/2018 Rosati ..... E04G 11/50
2003/0012607 A1 * 1/2003 Coday ..... E04G 11/38 405/272
2004/0075042 A1 * 4/2004 Arozena Bergaretxe ..... E04G 11/38 249/210
2009/0250589 A1 * 10/2009 Schworer ..... E04G 11/483 249/192
2009/0294627 A1 * 12/2009 Schwoerer ..... E04G 11/483 249/18
2012/0042600 A1 * 2/2012 Bacon ..... E04G 11/483 52/632
2014/0263941 A1 * 9/2014 Zhang ..... E04G 11/38 249/18

FOREIGN PATENT DOCUMENTS

DE 20320773 U1 3/2005
DE 102006015348 A1 10/2007
DE 102015223772 * 6/2017 ..... E04G 11/483
EP 0130425 A2 1/1985
EP 1251222 * 10/2002 ..... E04G 11/483
EP 2372044 A1 * 10/2011 ..... E04G 11/483
EP 2749713 * 7/2014 ..... E04G 11/483
FR 3017891 * 8/2015 ..... E04G 11/483
GB 1457136 A 12/1976

* cited by examiner

FORMWORK FOR PERFORMING HORIZONTAL CASTINGS FOR THE PROVISION OF FLOORS

The present invention relates to a formwork for performing horizontal castings for the provision of floors.

Formwork of the type comprising a series of props and supporting heads to be arranged on said props for the resting of panels designed to form a surface for a concrete casting are currently known and widespread for the provision of floors.

Each panel comprises at least two longitudinal profiles, for resting on the supporting heads, mutually connected by transverse elements.

The supporting heads and the longitudinal profiles of the panels are shaped so as to allow to hang a panel between two supporting heads, in an intermediate configuration for assembly or disassembly, i.e., before the panel is lifted in the horizontal configuration for use, or during removal of the panel.

Although these formwork systems are widespread and appreciated, they have drawbacks.

A first drawback is linked to the fact that the parts designed for hanging a panel between two supporting heads, while ensuring properly the coupling of a longitudinal profile to said supporting heads and the engaged retention of the panel, if the panel is pushed upward improperly while it is in the hanging configuration the longitudinal profile may disengage from the supporting heads with consequent dangers for the nearby operators and for the nearby formwork.

Moreover, the longitudinal profiles of the panel, to be used as described above, must be processed with operations for drilling and removing material in order to form passages for corresponding engagement portions formed on the supporting heads; at the same time, said supporting heads have a complex shape, with appropriately shaped engagement elements.

The aim of the present invention is to provide a formwork that is capable of obviating the limitations of formwork systems of the known type.

Within this aim, an object of the invention is to provide a formwork for performing horizontal castings for the provision of floors that allows the assembly of the formwork panels more safely, particularly as regards hanging with engagement of the formwork panel to the supporting heads, both during the steps for preparation for actual assembly and in the steps for final assembly and finally in the step for disassembly after use.

Another object of the present invention is to provide a formwork that is particular resistant to the loads applied thereto.

A further object of the present invention is to provide a formwork for floors that is provided with the safety system required by the standards in the field.

Another object of the invention is to provide a formwork that is simple and straightforward to use by workers.

Another object of the invention is to provide a formwork that is constructively simpler to provide, by means of production processes which are simple, quick and economically less expensive than similar formwork structures of a known type.

This aim, as well as these and other objects which will become better apparent hereinafter are achieved by a formwork for performing horizontal castings for the provision of floors, of the type comprising a series of props, and supporting heads, to be arranged on said props, for the resting of panels designed to form a plane for a concrete casting, each panel comprising at least two longitudinal profiles, for resting on said supporting heads, mutually connected by transverse elements, said formwork being characterized in that each one of said longitudinal profiles comprises a central body, a first longitudinal part, for fixing for said transverse elements, and an opposite second longitudinal part, for the resting of the longitudinal profile on a supporting head, each one of said supporting heads comprises a plate-like base from which there extends, on each of two opposite sides, at least one lateral shoulder for the resting of said central body of a said longitudinal profile in an intermediate configuration for assembly or disassembly, and a central protrusion, which is extended on the same side as said lateral shoulders, with cantilever lateral flaps, which are extended on the same side as a corresponding lateral shoulder, designed to form a tipping preventing abutment for said second longitudinal part of a said longitudinal profile in said intermediate configuration for assembly or disassembly.

Further characteristics and advantages of the invention will become better apparent from the description of a preferred but not exclusive embodiment of the formwork according to the invention, illustrated by way of non-limiting example in the accompanying drawings, wherein.

Figure 1:
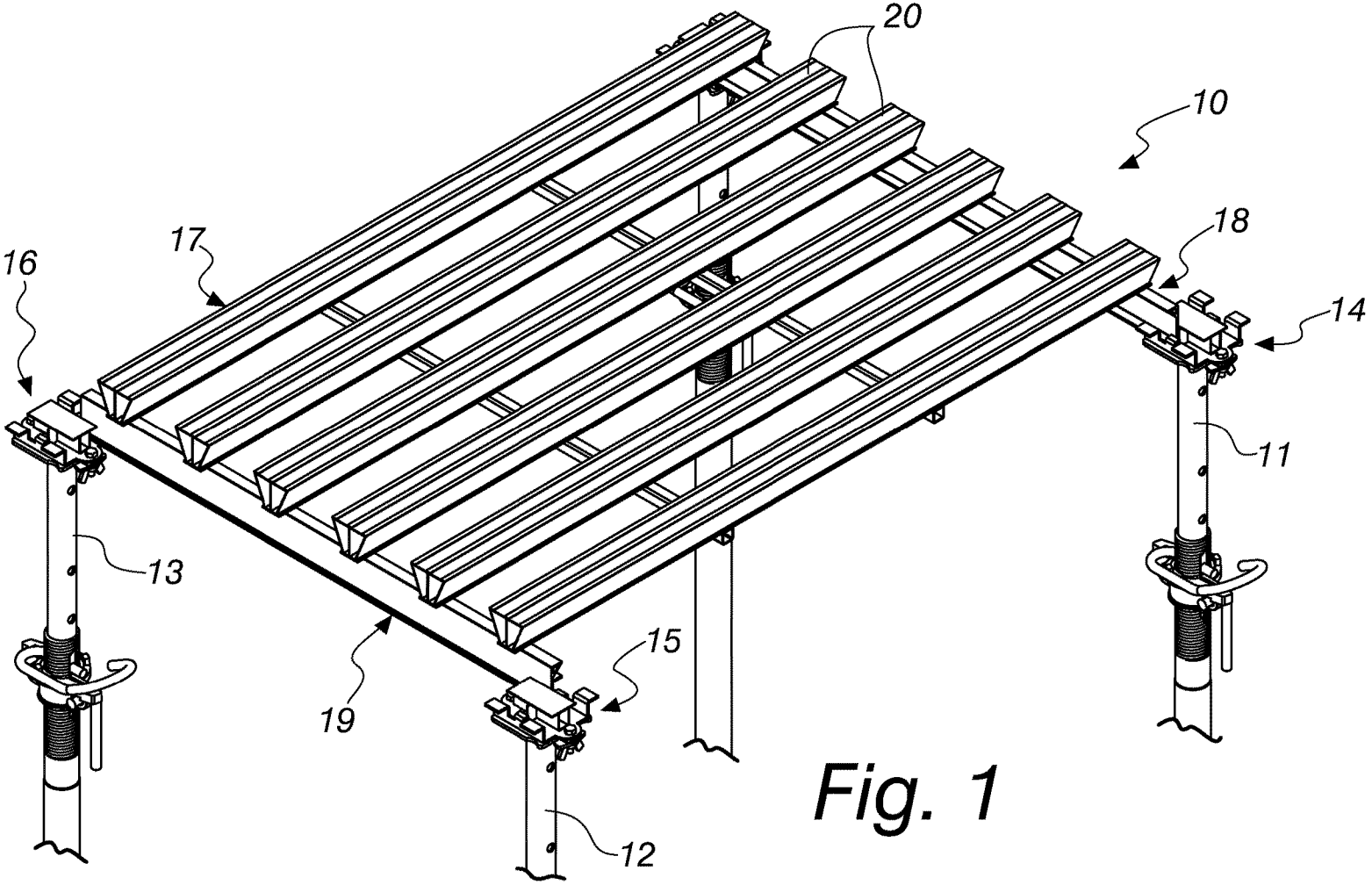
FIG. 1 is a perspective view of a formwork according to the invention.

With reference to the figures, a formwork for performing horizontal castings for the provision of floors, according to the invention, is generally designated by the reference numeral 10.

The formwork 10 comprises a series of props, of which, for example, three props are designated in FIG. 1 by the numerals 11, 12 and 13, and supporting heads, for example 14, 15, 16, to be arranged on the props 11, 12, 13 for the resting of panels, one of which is exemplified in FIG. 1 and is designated therein by 17, designed to form a surface for a concrete casting.

Each panel 17 comprises at least two lateral longitudinal profiles 18 and 19 for resting on the supporting heads 14, 15, 16.

The lateral longitudinal profiles 18 and 19 are mutually connected by transverse elements 20.

The formwork 10 according to the invention is characterized by the following particularities.

Figure 2:
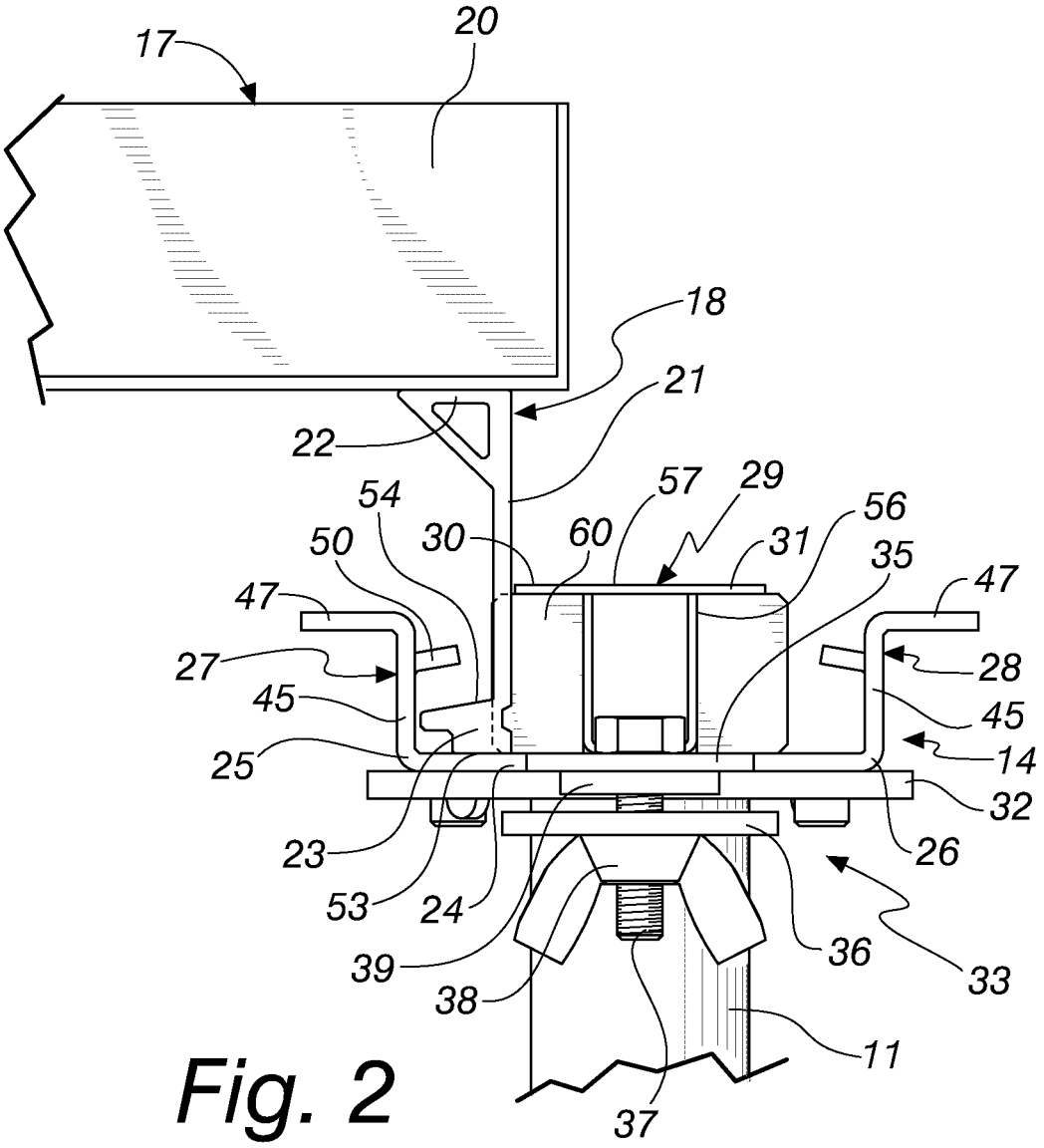
FIG. 2 is a front view of a detail of the formwork according to the invention.

Each one of the longitudinal profiles 18 and 19 comprises, as clearly visible in FIG. 2 for a first longitudinal profile 18:

a central body 21, a first longitudinal part 22, for fixing the transverse elements 20, and an opposite second longitudinal part 23, for the resting of the longitudinal profile 18 and 19 on a supporting head 14, 15 and 16.

Figure 8:
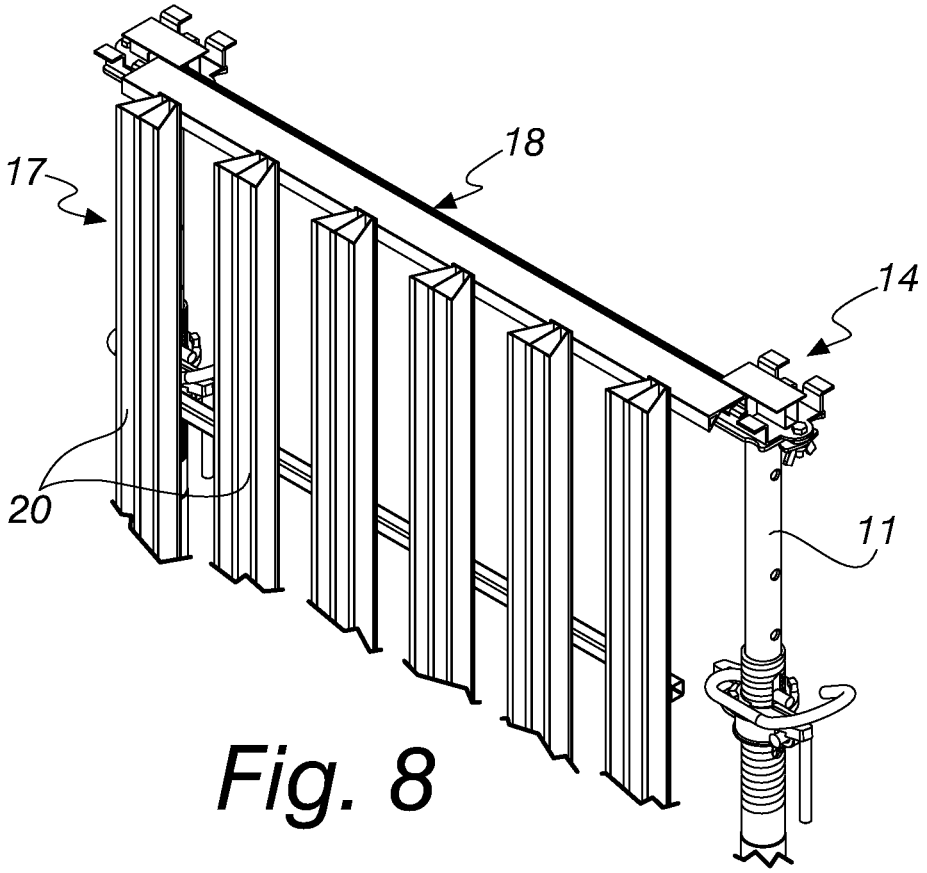
FIG. 8 is a perspective view of a formwork according to the invention in an intermediate configuration for assembly or disassembly.
Figure 9:
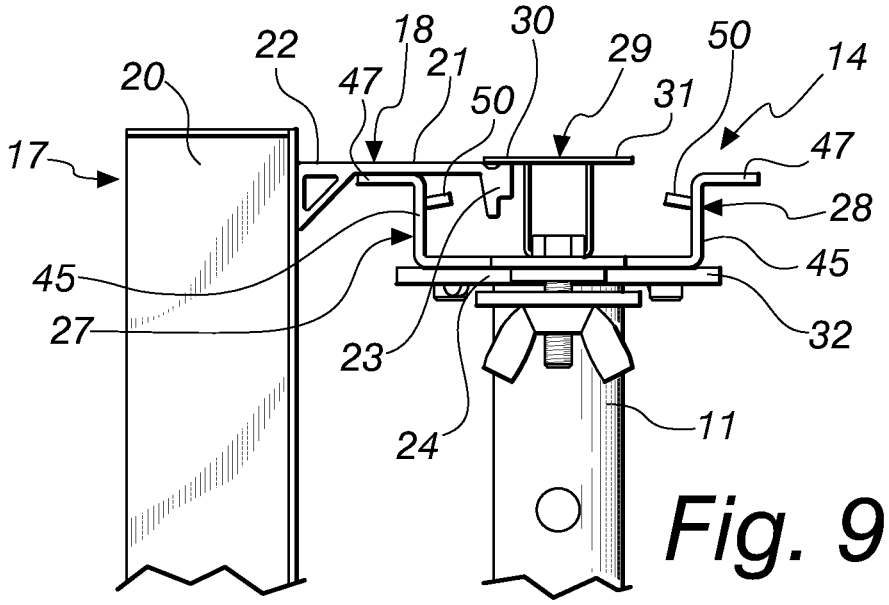
FIG. 9 is a front view of a detail of FIG. 8.

Each one of the supporting heads 14, 15, 16 comprises:

a plate-like base 24 from which plate-like base 24 there extends, on each of two opposite sides 25 and 26, a lateral shoulder, 27 and 28 respectively, for the resting of the central body 21 of a longitudinal profile 18 and 19 in an intermediate configuration for assembly or disassembly, as in FIGS. 8 and 9, and a central protrusion 29, which is extended on the same side as the lateral shoulders 27 and 28, with cantilever lateral flaps 30 and 31, extended on the same side as a corresponding lateral shoulder 27 and 28, designed to form a tipping preventing abutment for the second longitudinal part 23 of a longitudinal profile 18 and 19.

The plate-like base 24 is quadrangular, and is provided with means for fixing to a corresponding end plate 32 of a prop, for example 11.

Figure 3:
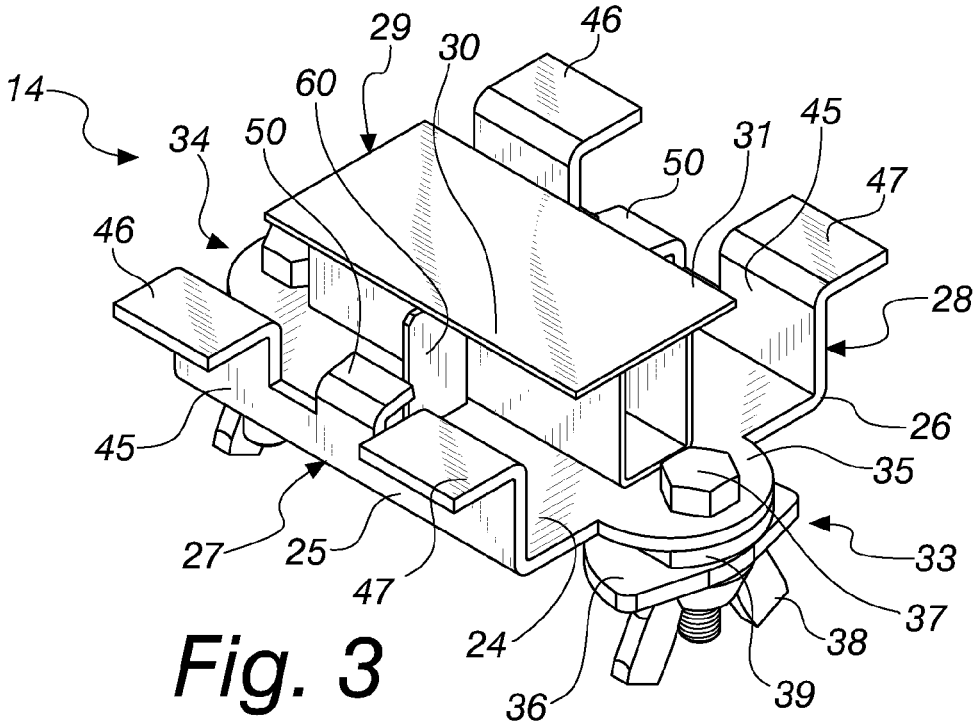
FIG. 3 is a perspective view of a supporting head of a formwork according to the invention.
Figure 4:
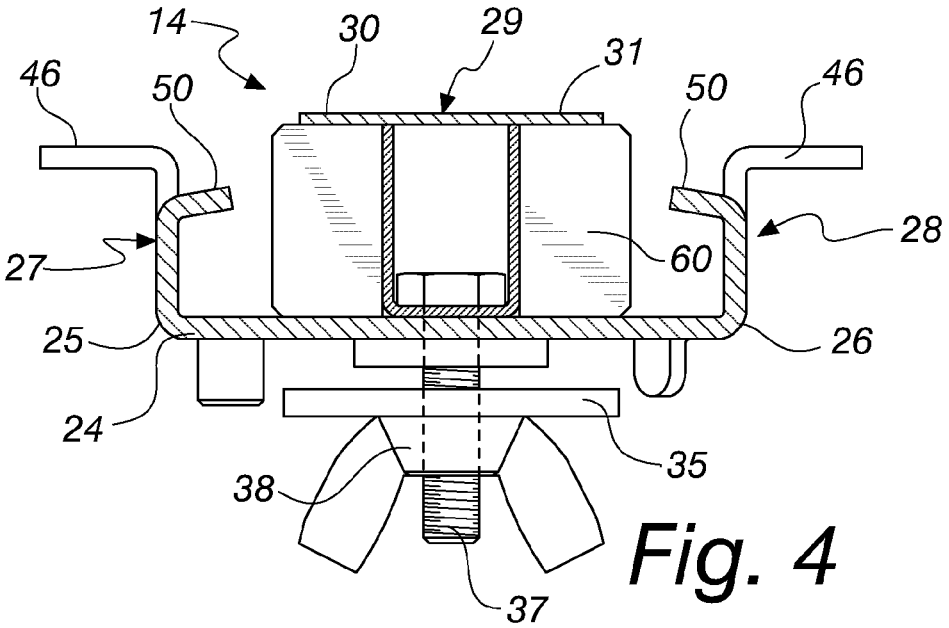
FIG. 4 is a transverse sectional view of the supporting head of FIG. 3.
Figure 5:
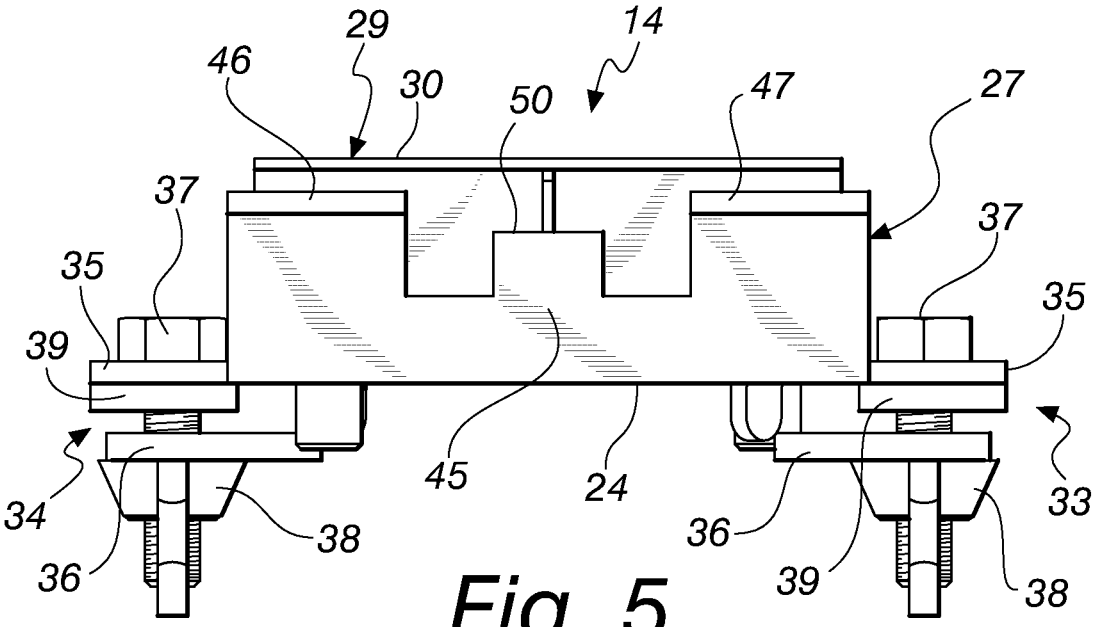
FIG. 5 is a side view of a supporting head as in FIG. 3.

Said fixing means, in a first constructive variation shown in FIGS. 3, 4 and 5, are constituted by two opposite clamp devices 33 and 34, arranged on the two sides of the plate-like base 24 that are free from the shoulders 27 and 28.

The clamp devices 33 and 34 are each constituted by a tab 35 of the plate-like base 24 and by an opposite grip plate 36, each of which forms a jaw of the clamp device, there being a screw 37 and a corresponding bolt or wing nut 38 for the fastening of the tab 35 and the plate 36 on a corresponding edge of the end plate 32 of a prop 11.

Below the tabs 35 there are corresponding centering shims 39 designed to facilitate the correct positioning of the supporting head 14 on the plate 32.

Figure 6:
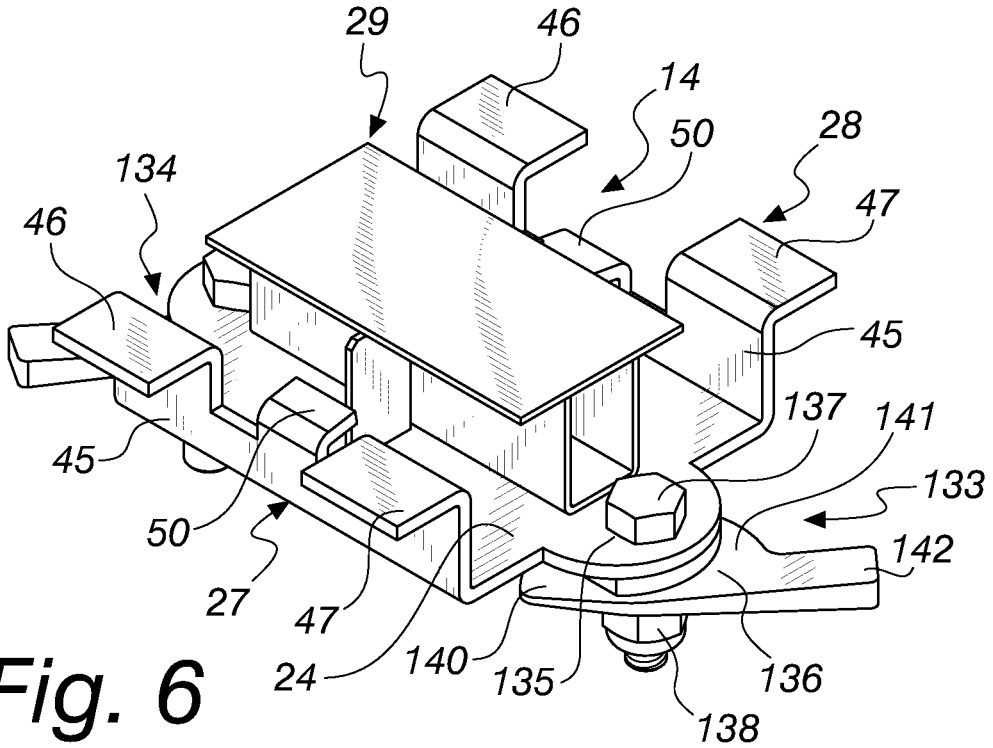
FIG. 6 is a view of a supporting head in a constructive variation thereof.
Figure 7:
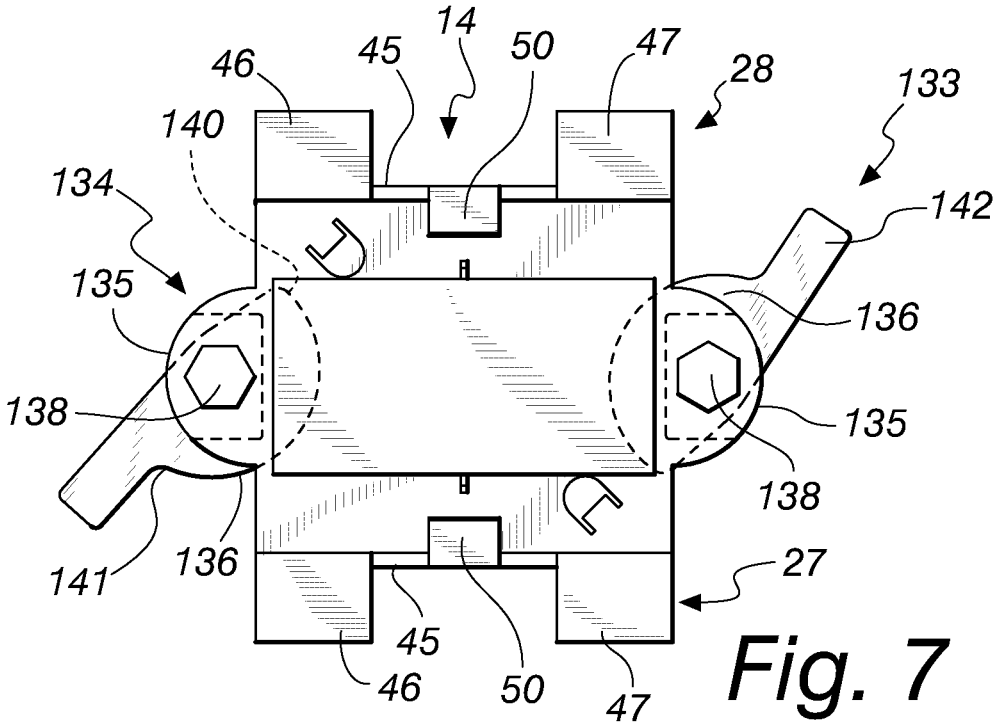
FIG. 7 is a view from above of the supporting head of FIG. 6.

The fixing means, in a second constructive variation shown in FIGS. 6 and 7, are constituted by two opposite wedge-like devices 133 and 134, arranged on the two sides of the plate-like base 24 that are free from the shoulders 27 and 28.

The wedge-like devices 133 and 134 are each constituted by a tab 135 of the plate-like base 24 and by an opposite wedge-like plate 136, which is pivoted to a screw 137 that passes through the tab 135 and is retained thereon by means of a bolt or nut 138.

The wedge-like plate 136 has a plate-like body provided with a hole for pivoting to the stem of the screw 137, which has an arc-like perimetric profile edge, which increases in thickness from a first end 140 to the opposite second end 141 of said arc-like edge.

The wedge-like plate 136 can rotate about the stem of the screw 137, by means of a maneuvering tab 142, between an engagement configuration exemplified in FIG. 7, with a plate arranged below the head 32 of a prop 11, and a disengagement configuration, with the plate 136 rotated so as to not affect the head 32.

The lateral shoulders 27 and 28 are each constituted by a lower part 45, which extends from the plate-like base 24 over the entire length of the corresponding side 25 and 26, and by two resting wings 46 and 47, which are bent outwards in the configuration for use of the supporting head 14, and spaced in the direction of extension of the same corresponding side 25 and 26.

In the present example of embodiment, the lower part 45 is extended at right angles to the plate-like base 24.

In the present example of embodiment, the resting wings 46 and 47 are extended along a plane that is parallel to the plate-like base 24.

An auxiliary protrusion 50 is provided between two laterally adjacent resting wings 46 and 47, and extends from the same lower part 45 toward the central protrusion 29, designed to make contact with the lower part 23 of a longitudinal profile 18 and 19 in order to guide its rotation.

The auxiliary protrusion 50 is constituted by a wing that extends from the lower part 45 of the shoulder 27 and 28, which is bent toward the central protrusion 29, at a lower height with respect to the resting wings 46 and 47.

Figure 10:
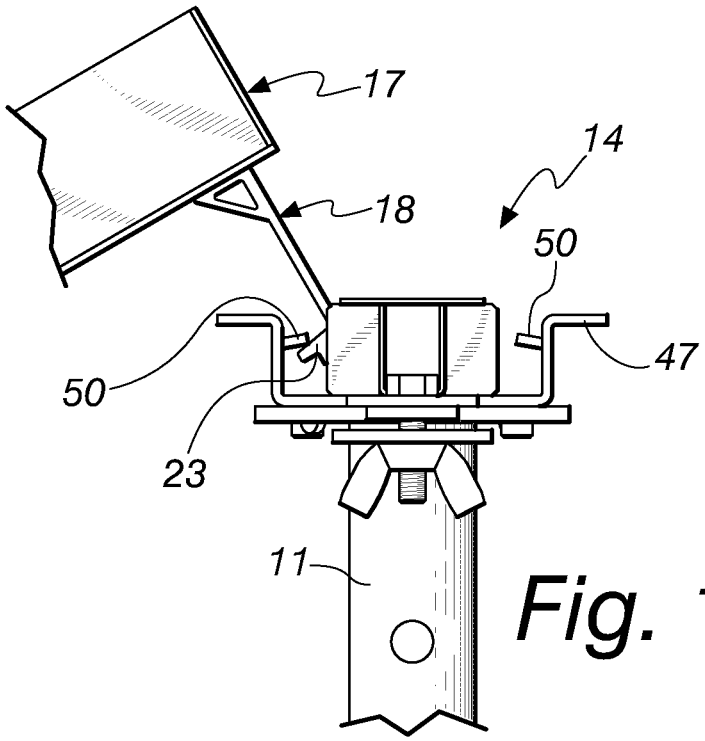
FIGS. 10 to 12 are each a view of a step of assembly of a panel on a supporting head of a formwork according to the invention.
Figure 11:
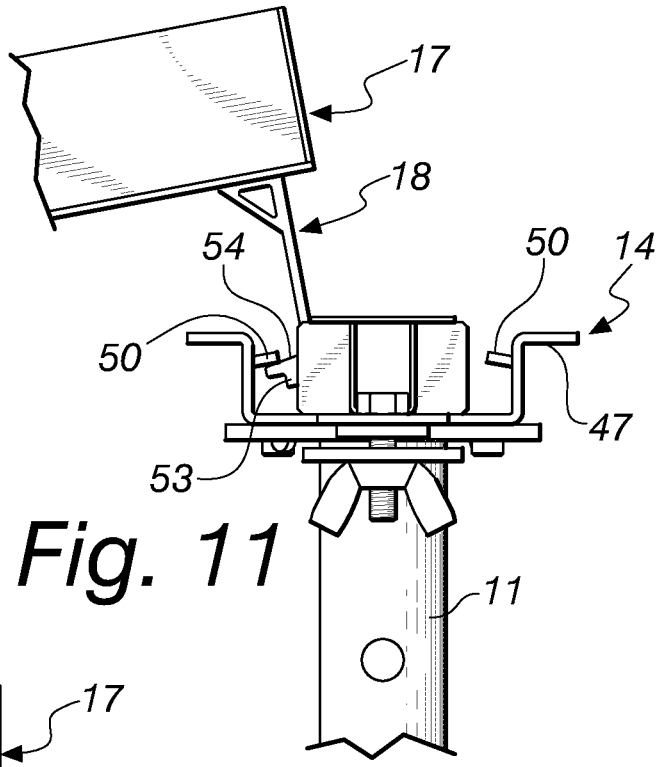
Figure 12:
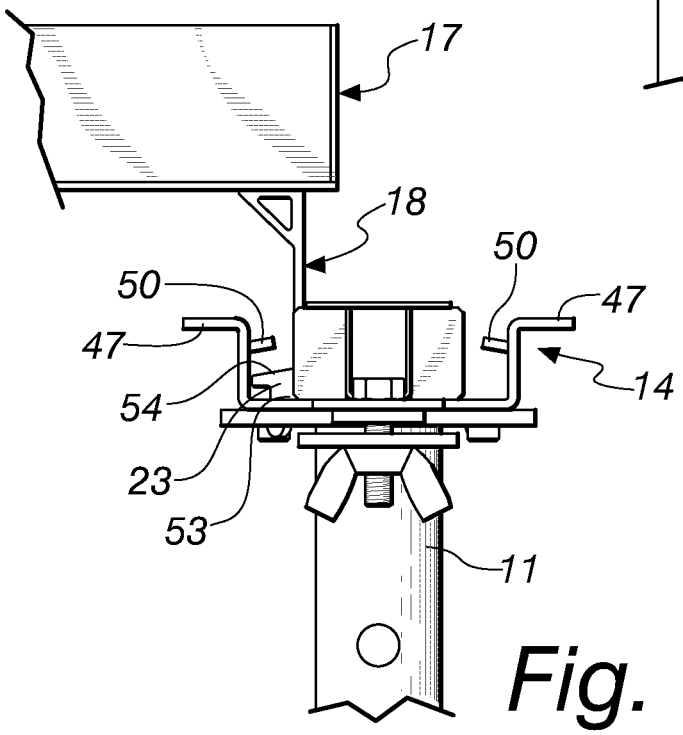

The longitudinal profile 18 as well as 19 is constituted, in the present example of embodiment, by a single metallic drawn member, in which the central body 21 is plate-shaped, the first part 22 is tubular with a triangular cross-section, and the second part 23 widens on one side into a ridge, which is obviously longitudinal and the lower surface 53 of which is designed for resting on the plate-like base 24, while its upper surface 54 is designed to meet the auxiliary protrusion 50 in the assembly and disassembly steps, as visible from FIGS. 10, 11 and 12, which in the described sequence represent three distinct steps of the mounting of a profile 18 on a supporting head 14.

The central protrusion 29 is constituted, in the embodiment of the invention described herein, which is a nonlimiting example of the invention, by a U-shaped bracket 56, which is fixed to the plate-like base 24, and by an upper plate 57, the lateral portions of which constitute the cantilever lateral flaps 30 and 31.

The supporting heads 14 also have vertical partitions 60 adapted to prevent the translation of the longitudinal profiles 18 and 19 in the direction of their longitudinal extension.

Figure 13:
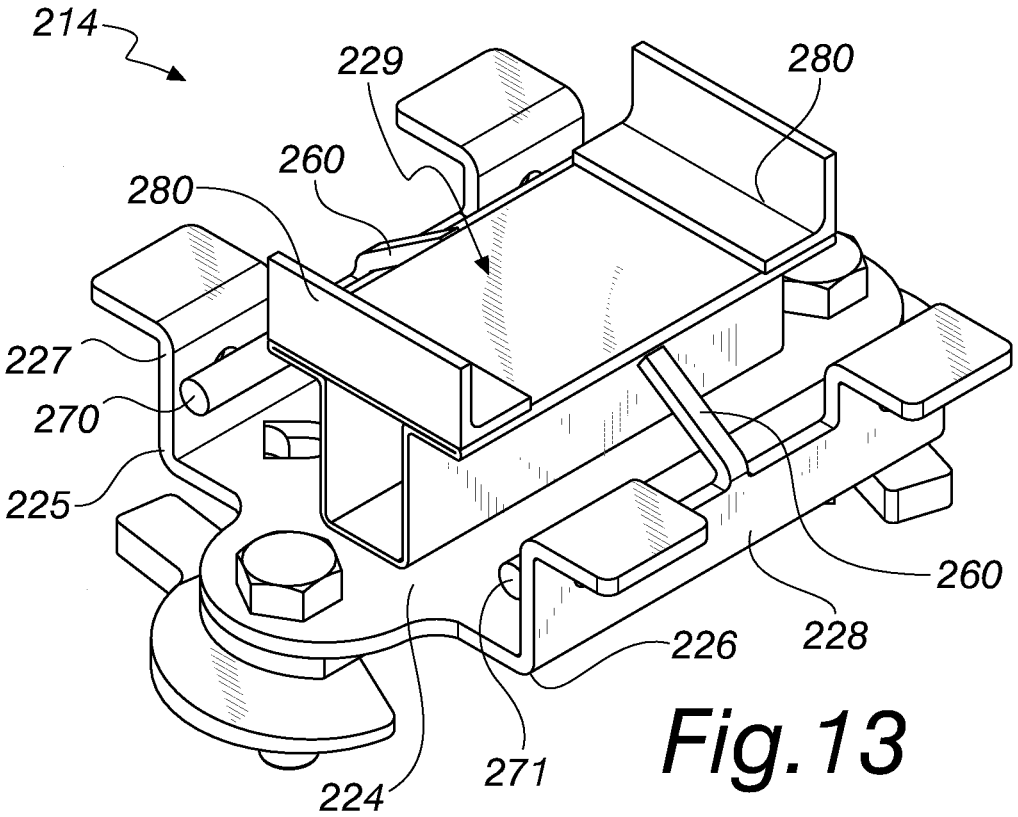
FIG. 13 is a view of a constructive variation of a supporting head according to the invention.
Figure 14:
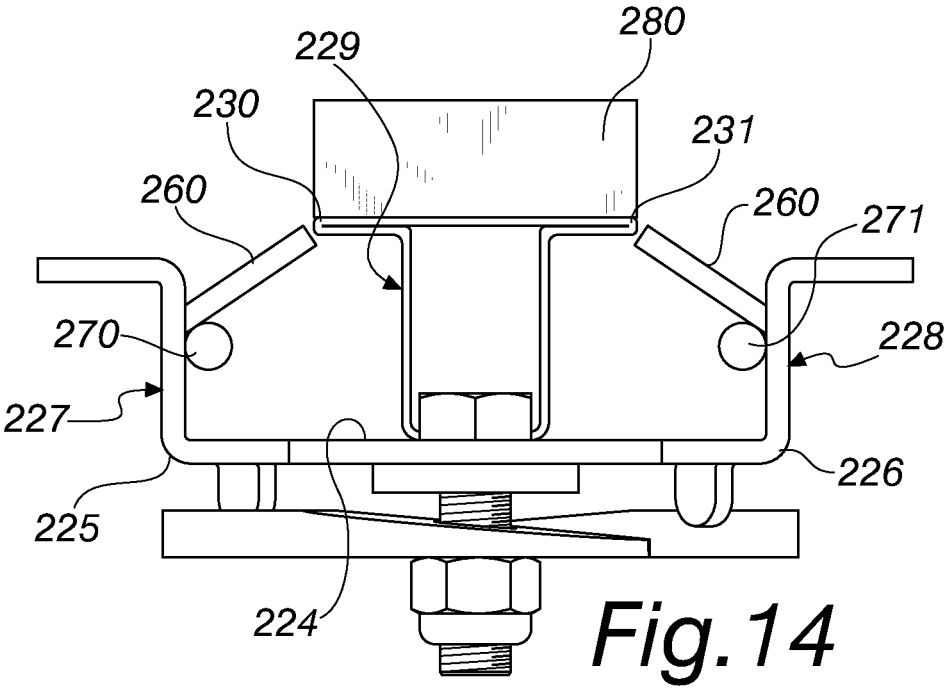
FIG. 14 is a front view of the supporting head of FIG. 13.

In a constructive variation of the invention, clearly visible in FIGS. 13 and 14 and designated therein by the reference numeral 214, the supporting head 214 comprises:

a plate-like base 224 from which plate-like base 224 there extends, on each of two opposite sides 225 and 226, a lateral shoulder, respectively 227 and 228, for the resting of the central body 21 of a longitudinal profile 18 and 19 in an intermediate configuration for assembly or disassembly, and a central protrusion 229, which is extended on the same side as the lateral shoulders 227 and 228, with cantilever lateral flaps 230 and 231, extended on the same side as a corresponding lateral shoulder 227 and 228, designed to form a tipping preventing abutment for the second longitudinal part 23 of the longitudinal profile 18 and 19.

Inside each one of the lateral shoulders 227 and 228 there is a cylindrical body, respectively 270 and 271, arranged with an axis which is parallel to the arrangement of the plate-like base 224, designed to facilitate the rotary motion of a longitudinal profile 18 and 19 of a panel 17, both during assembly and during disassembly of the longitudinal profile from a similar supporting head 224.

In particular, the cylindrical body 270 and 271 is constituted by a cylindrical bar that is extended over the entire length of the corresponding lateral shoulder 227 and 228, for example fixed by welding.

In this constructive variation, the supporting head 214 has, for each lateral shoulder 227 and 228, a translation-preventing central tab 260, adapted to prevent the translation of the longitudinal profiles 18 and 19 in the direction of their longitudinal extension.

Each one of the translation-preventing central tabs 260 extends from the corresponding shoulder 227 and 228 up to the vicinity of a nearby cantilever flap 230 and 231 of the central protrusion 229; in this position, each translation-preventing tab 260 is adapted to affect and prevent any translational motions of a longitudinal profile 18 and 19 engaged with the supporting head 214.

In this constructive variation of the supporting head 214, at the ends of the central protrusion 229 there are two angular resting elements 280, which act as stop elements for the panels 17 when the assembly step is complete: once assembly has ended, the last panel of a series of panels that are laterally adjacent at right angles to the longitudinal profiles 18 and 19, tends not to constitute a fixed system with a corresponding last prop, which tends to tilt, with a consequent risk of uncoupling between the supporting head and the longitudinal profile that is engaged therewith, since there is no further subsequent panel that cooperates to keep the prop in the correctly vertical configuration.

The angular resting elements 280 act so as to prevent the unwanted tilting of the supporting head 214, and therefore of the prop that supports it, with respect to the longitudinal profile 18 or 19 that is engaged therewith, and therefore with respect to a panel 17.

In practice it has been found that the invention achieves the intended aim and objects.

The cantilever lateral flaps 30 and 31 in fact prevent the unwanted disengagement of the longitudinal profile 18 and 19 of a panel 17 from a supporting head 14, both in the assembly configuration and in the disassembly configuration.

In particular, the resting wings 46 and 47 cooperate to keep the central body 21 of a longitudinal profile 18 and 19 substantially horizontal in the intermediate configuration for assembly or disassembly shown in FIG. 9, with the central body 21 resting on the resting wings 46 and 47 and the second part 23 rested on a lateral tipping preventing flap 30, so as to prevent the weight of the transverse elements 20 from causing the downward rotation and the disengagement of the panel 17.

Therefore, the invention provides a formwork for performing horizontal castings for the provision of floors that allows to assemble the formwork panels more safely, in particular as regards hanging with engagement of the formwork panel to the supporting heads, both during steps for preparing for actual assembly and in the steps of final assembly and finally in the step of disassembly after use.

By means of the invention, a formwork has been provided which is particularly resistant to the loads applied thereto and has a performance that is not lower than that of known formwork.

Moreover, by means of the invention a formwork for floors has been devised which is provided with the safety systems required by standards in the field.

Furthermore, by means of the invention a formwork has been provided which is simple and straightforward to use for workers.

Moreover, by means of the invention a formwork has been provided which is constructively simpler to provide, by virtue of production processes that are simple, fast and economically less expensive than similar formwork of the known type.

The invention thus conceived is susceptible of numerous modifications and variations, all of which are within the scope of the appended claims; all the details may furthermore be replaced with other technically equivalent elements.

In practice, the components and the materials used, so long as they are compatible with the specific use, as well as the contingent shapes and dimensions, may be any according to requirements and to the state of the art.

The disclosures in Italian Patent Application No. 102016000030716 (UA2016A001964) from which this application claims priority are incorporated herein by reference.

What is claimed is:

1. Formwork for performing horizontal castings for the provision of floors, of the type comprising a series of props, and supporting heads to be arranged on said props for the resting of panels designed to form a surface for a concrete casting, each panel comprising at least two longitudinal profiles, for resting on said supporting heads, which are mutually connected by transverse elements, each one of said longitudinal profiles comprising a central body, a first longitudinal part, for the fixing of said transverse elements, and an opposite second longitudinal edge part, for the resting of the longitudinal profile on a supporting head, each one of said supporting heads comprising a plate-like base from which there extends, on each of two opposite sides, at least one lateral shoulder for the resting of said central body of a said longitudinal profile in an intermediate configuration for assembly or disassembly, and a central protrusion, which protrudes from the same side as said lateral shoulders, with cantilever lateral flaps, which extends from the same side as a corresponding lateral shoulder, designed to form a tipping preventing abutment for said second longitudinal part of a said longitudinal profile in said intermediate configuration for assembly or disassembly, wherein inside each one of the lateral shoulders there is a cylindrical body, arranged with its axis parallel to the arrangement of the plate-like base, designed to facilitate the rotary motion of a longitudinal profile of a panel.

2. The formwork according to claim 1, wherein said plate-like base is provided with means for fixing to a corresponding end plate of a prop.

3. The formwork according to claim 2, wherein said fixing means are constituted by two opposite clamp devices, arranged on the two sides of the plate-like base that are free from the shoulders.

4. The formwork according to claim 2, wherein said fixing means are constituted by two opposite wedge-like devices, arranged on the two sides of the plate-like base that are free from the shoulders.

5. The formwork according to claim 1, wherein said lateral shoulders are each constituted by a a lower part, which extends from the plate-like base over the entire length of the corresponding side and by two resting wings, which are folded outward in the configuration for use of the supporting head, and spaced in the direction of extension of the same corresponding side.

6. The formwork according to claim 5, wherein said lower part is extended at right angles to the plate-like base, said resting wings extending along an arrangement that is parallel to the plate-like base.

7. The formwork according to claim 5, wherein an auxiliary protrusion is provided between said resting wings, extends from said lower part toward the central protrusion, and is designed to make contact with the second longitudinal part of the longitudinal profile to guide the rotation thereof.

8. The formwork according to claim 7, wherein said auxiliary protrusion is constituted by a wing that extends from the lower part of the shoulder, bent toward the central protrusion, at a lower height than the resting wings.

9. The formwork according to claim 7, wherein said longitudinal profile is constituted by a single metallic drawn member, in which the central body is plate-like, the first longitudinal part is tubular with a triangular cross-section, and the second longitudinal part widens on one side into a ridge the lower surface of which is designed to rest on the plate-like base, while its upper surface is designed to meet the auxiliary protrusion in the assembly and disassembly steps.

10. The formwork according to claim 1, wherein said central protrusion is constituted by a U-shaped bracket, fixed to the plate-like base, and by an upper plate the lateral portions of which form said cantilever lateral flaps.

11. The formwork according to claim 1, wherein said cylindrical body is constituted by a cylindrical bar that extends over the entire length of the corresponding lateral shoulder.

12. The formwork according to claim 1, wherein said supporting head has, for each lateral shoulder, a translation-preventing central tab adapted to prevent the translation of the longitudinal profiles in the direction of their longitudinal extension.

13. The formwork according to claim 12, wherein each one of said translation-preventing central tabs extends from the corresponding shoulder to the vicinity of a nearby cantilever flap of a central protrusion.

14. The formwork according to claim 1, wherein said supporting head has, at ends of the central protrusion, two angular resting elements, which act as stop elements for the panels.

* * * * *